United States Patent [19]

Fukushima et al.

[11] Patent Number: 4,969,641

[45] **Date of Patent: * Nov. 13, 1990**

[54] MEDIA RECEIVING UNIT

[75] Inventors: Toshio Fukushima; Masato Kawashima, both of Kawasaki; Moriaki Miyashige, Kakogawa; Toshikazu Niwa, Hyogo, all of Japan

[73] Assignee: Fujitsu Limited, Kawasaki, Japan

[ * ] Notice: The portion of the term of this patent subsequent to Sep. 13, 2005 has been disclaimed.

[21] Appl. No.: 242,388

[22] Filed: Sep. 9, 1988

Related U.S. Application Data

[63] Continuation of Ser. No. 855,651, Apr. 25, 1986, Pat. No. 4,770,405.

[30] Foreign Application Priority Data

| | | | |
|---|---|---|---|
| Apr. 27, 1985 | [JP] | Japan | 60-091513 |
| May 8, 1985 | [JP] | Japan | 60-096965 |
| May 31, 1985 | [JP] | Japan | 60-118016 |
| Sep. 18, 1985 | [JP] | Japan | 60-205612 |
| Dec. 20, 1985 | [JP] | Japan | 60-288283 |

[51] Int. Cl.[5] ..... B65H 29/06

[52] U.S. Cl. ..... 271/187; 271/213; 271/215; 414/791.2

[58] Field of Search ..... 271/291, 186, 187, 184, 271/207, 213; 414/791.2

[56] References Cited

U.S. PATENT DOCUMENTS

| | | | |
|---|---|---|---|
| 3,010,717 | 11/1961 | Zabriski | 271/212 |
| 3,904,192 | 9/1975 | Pfeifer | 271/186 |
| 4,228,997 | 10/1980 | Schoonmaker | 271/315 |
| 4,252,309 | 2/1981 | Garrison | 271/186 |
| 4,275,876 | 6/1981 | Imaizumi | 271/207 X |
| 4,431,177 | 2/1984 | Beery | 271/187 X |
| 4,449,812 | 5/1984 | Furuichi | 271/294 X |
| 4,650,177 | 3/1987 | Hauger | 271/305 |
| 4,669,717 | 6/1987 | Yamashita | 271/186 |

FOREIGN PATENT DOCUMENTS

| | | |
|---|---|---|
| 0-021-398 | 1/1981 | European Pat. Off. . |
| 149264 | 8/1984 | Japan . |

OTHER PUBLICATIONS

IBM Technical Disclosure Bulletin, vol. 18, No. 7, 12/1975.

IBM Technical Disclosure Bulletin, vol. 23, No. 7A, 12/1980.

*Primary Examiner*—Richard A. Schacher

*Attorney, Agent, or Firm*—Armstrong, Nikaido, Marmelstein, Kubovcik & Murray

[57] ABSTRACT

A media receiving unit is provided. The unit comprises a media receiver for receiving media (sheets of paper) discharged from a media processing apparatus such as a printer; a rotary member; at least a pair of flexible sheets for holding the medium and provided on the periphery of the rotary member; and a stopper for separating the medium from the flexible sheets. The flexible sheets hold a front end of the medium therebetween, are bent when in contact with the medium according to the rotation of the rotary member, and, when a rear end of the medium is released from the media processing apparatus, flip the rear end of the medium with an elastic rstoring force thereof while holding the front end of the medium to reverse the medium and place the medium in the media receiver. Thus, the media are properly reversed and received in the media receiver.

10 Claims, 20 Drawing Sheets

MEDIA RECEIVING UNIT

This is a continuation of application Ser. No. 855,651 filed Apr. 25, 1986, now U.S. Pat. No. 4,770,405.

BACKGROUND OF THE INVENTION

1. Field of the Invention

The present invention relates to a media receiving unit for receiving printed media (sheets of paper) discharged from a printer, a copying machine, etc.

2. Description of the Related Art

Generally, recorded media (printed papers) discharged from a printing machine such as a printer and a copying machine are accumulated with the printing thereon facing upward in a receiver of a media receiving unit disposed under the printing machine.

This method is advantageous when monitoring whether or not the printing conditions of the papers are proper, but is disadvantageous in that papers which have been printed sequentially are piled up in a reversed sequence in the receiver.

To overcome this disadvantage, some prior art mechanisms have been proposed by which the sequence of papers discharged from the printing machine is reversed. These prior art mechanisms, however, cannot effect this reversal of the paper at a low cost. Therefore, there is still required the provision of a compact mechanism which will properly effect the reversal of papers at a low cost.

SUMMARY OF THE INVENTION

It is an object of the present invention to provide a media receiving unit which is compact and can properly reverse the printed media (papers) received from a printer, copying machine, etc.

To accomplish this object, the present invention provides a media receiving unit comprising a media reception means for sequentially receiving one upon another a plurality of sheet media which are discharged from a media processing apparatus; a rotary member having an axis of rotation which extends perpendicular to a discharging direction of the media; at least a pair of flexible sheets provided at the periphery of the rotary member and having a greater flexibility than that of the media, the flexible sheets holding the front end of the medium therebetween and being bent when touching the medium according to the rotation of the rotary member, and when the rear end of the medium is released from the media processing apparatus, flipping the rear end of the medium with an elastic restoring force thereof while holding the front end of the medium, to thereby reverse the medium and place the medium in the media reception means; and a stopper means which abuts against the front end of the medium held by the flexible sheets and separates the medium from the flexible sheets in cooperation with the rotation of the rotary member.

BRIEF DESCRIPTION OF THE DRAWINGS

These and other objects and features of the present invention will become apparent from the following description with reference to the accompanying drawings, in which:

FIGS. 6A, 6B and 6C are views showing the overall constitution of the embodiment shown in FIG. 5, wherein FIG. 6A is a front view, FIG. 6B a plan view, and FIG. 6A–C a side view;

DESCRIPTION OF THE PREFERRED EMBODIMENTS

Before describing the preferred embodiments of the present invention, explanations will be given of the prior art for reference.

Figure 20A:
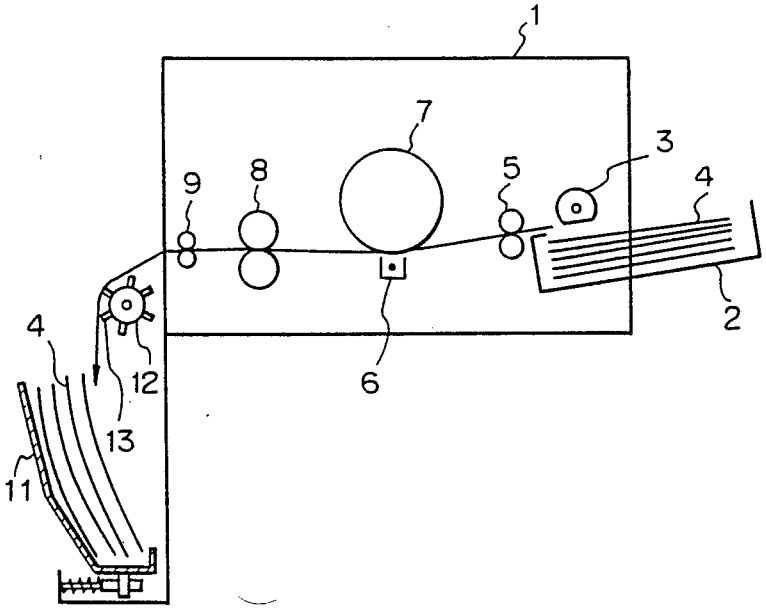
FIG. 20A–D are views for explaining prior art devices.

FIG. 20A shows a printer 1 to which the present invention is applicable. In the printer 1, papers 4 are set in a paper cassette 2, picked up one by one by a pick roller 3, and sent by a feed roller 5 to a photosensitive drum 7, where an image on the drum 7 is transferred to the paper 4 by a transferring device 6. The image on the paper 4 is then fixed by a fixing device 8, and the paper 4 is discharged outside the printer 1 by a discharge roller 9.

FIG. 20A shows an example of a prior art mechanism for reversing papers. In this example, a wheel 12 having rubber fins 13 is rotated by a motor (not shown). The rubber fins 13 touch a reverse side (opposite side of a printed side) of the paper 4 to turn the paper 4 over and place it in a stacker 11.

Figure 20B:
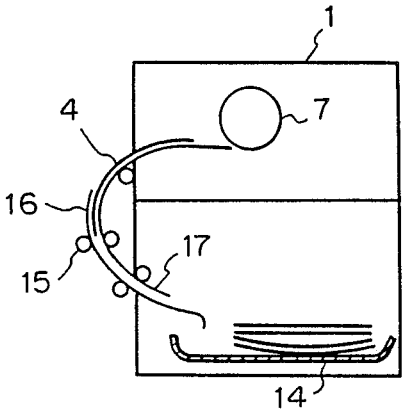

FIG. 20B shows another prior art mechanism for reversing papers. A tray 14 for receiving papers is provided under a printer 1. A paper 4 is fed by feed rollers 15 along reversing guides 16 and 17 which turn the paper 4 over and send it into the tray 14 in which the paper 4 is piled.

Figure 20C:
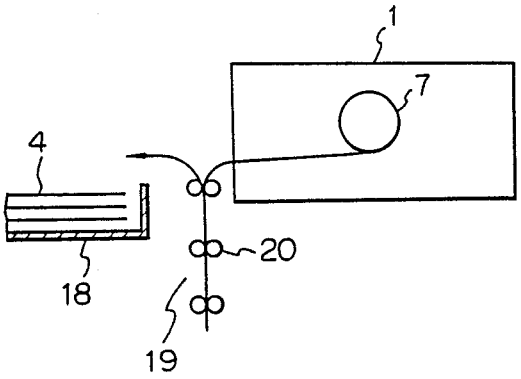

FIG. 20C shows still another prior art mechanism for reversing papers. A switchback means 19 comprising feed rollers 20 which are reversibly driven turns a paper 4 over to pile the paper 4 in a stacker 18.

Figure 20D:
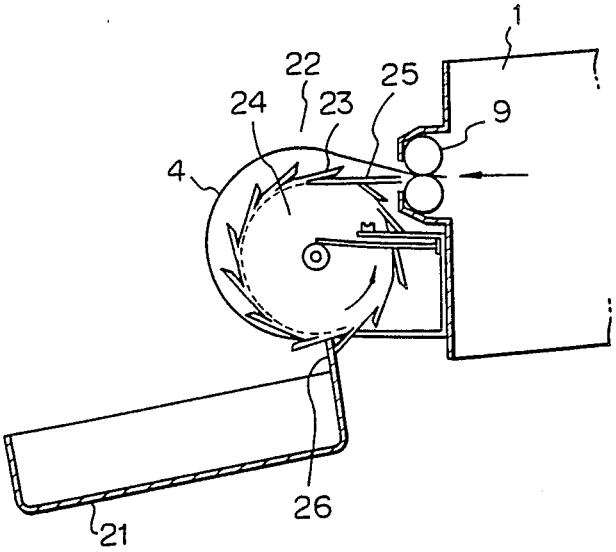

FIG. 20D shows still another prior art mechanism for reversing papers and receiving the papers in a media receiver 21, in which a collecting wheel 22 comprising linear nails 23 fitted to a rotary shaft 24 is used. The collecting wheel 22 is disposed in the middle of a paper guide 25. A paper 4 discharged from a discharge roller 9 is received by one of the nails 23, and the discharge force of the paper 4 causes the collecting wheel 22 to turn. The paper 4 then abuts against a stopper 26 of the media receiver 21, and is received in the media receiver 21 in a reversed state.

The prior art reversing mechanism shown in FIG. 20A, which makes use of gravity, needs a large installation space because the media receiver 11 must be arranged below the discharge roller 9. Further, the mechanism has a drawback in that the reversing operation by gravity may not be surely performed if the paper 4 is curled.

The prior art reversing mechanism shown in FIG. 20B is disadvantageous in that the mechanism is bulky, because it requires a number of components such as the rollers 15 and guides 16 and 17.

In the prior art reversing mechanism shown in FIG. 20C, a second paper is fed only after the completion of feeding of a first paper so that the timing of paper discharge is limited the process is slow.

If the paper 4 is curled in the prior art reversing mechanism shown in FIG. 20D, the discharge force of the paper 4 is weakened and the collecting wheel 22 is not turned by this force. Further, if the size of the paper 4 is large, the rear end of paper 4 is not released from the discharge roller 9 when the paper leading end abuts against the stoppers, therefore the paper 4 is not received in the media receiver 21.

The present invention has been developed in order to overcome the above drawbacks of the prior art and provides a media receiving unit provided with a rotary drum which is disposed in front of a media discharge port of a printing machine and equipped with flexible sheets, in which a paper is reversed by the resiliency of the flexible sheets.

Figure 1:
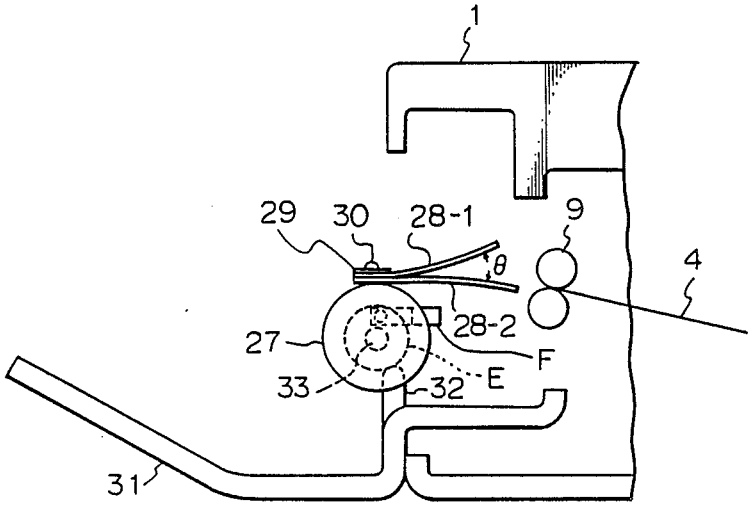
FIG. 1 is a cross-sectional view showing a principle embodiment according to the present invention.
Figure 2:
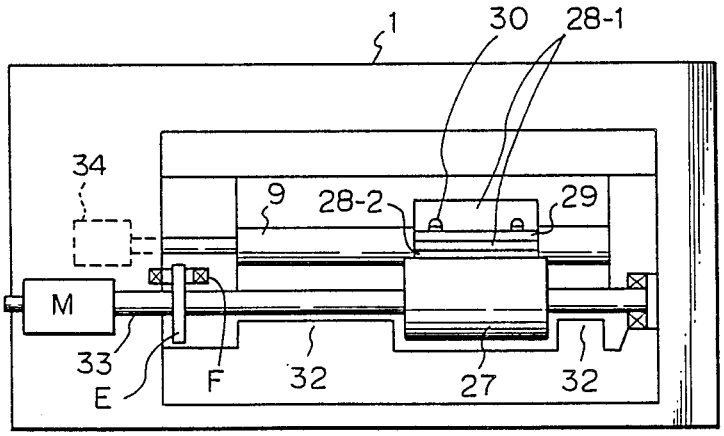
FIG. 2 is a front view showing the embodiment shown in FIG. 1.

FIG. 1 is a cross-sectional view and FIG. 2 is a front view of an embodiment of the present invention. FIG. 3 is a view for explaining the operation of the embodiment. A rotary drum 27 is connected with a step motor M through a shaft 33. The step motor M is fixed to one side of a recording apparatus 1 and driven in response to a rotation control signal sent from a controlling portion (not shown).

A paper 4 is discharged with a feeding speed of $V_0$ from a discharge roller 9 arranged in the recording apparatus 1. The rotary drum 27 shown in FIG. 1 is in a standby state waiting for the paper 4 to be discharged, and at this position, flexible sheets 28-1 and 28-2 made of polyester film and fixed to the rotary drum 27 are opened by an angle $\theta$ to receive the paper 4 therebetween. The flexible sheets 28—1 and 28—2 are fixed to the rotary drum 27 by screws 30 through a fitting 29.

A separation stopper 32 is disposed under the rotary drum 27 in such a manner that the stopper 32 extends on both sides with the circumference of the rotary drum 27 toward a shaft 33. The paper 4 is stopped by the stopper 32 and dropped in a stacker 31. The recording apparatus 1 is provided with a motor 34 for rotating the discharge roller 9. An encoder E for detecting the standby position of the rotary drum 27 is fixed to the shaft 33. A detection hole which emits a signal detected by a photosensor F is formed on the encoder E to detect a standby state.

The paper 4 discharged from the discharge roller 9 is reversed as shown in FIGS. 3A to D and described later. Usually, a sensor is disposed between a fixing device of the recording apparatus 1 and the discharge roller 9 to detect the passage of a paper. According to a detection signal of the sensor, the rotary drum 27 is rotated after maintaining a standby state for a predetermined period of time.

The length of upper flexible sheet 28—1 may by made shorter than that of the lower flexible sheet 28—2 to ensure that the paper 4 slips easily between them. In this embodiment, the length of the flexible sheet 28—1 is 50 mm to 100 mm.

The rotary drum 27 is rotated at a circumferential speed of about $0.8V_0$ which is slower than the discharge speed $V_0$ of paper 4. As a result, the paper 4 is fed between the flexible sheets 28-1 and 28-2 and bent as shown in FIG. 3B, and the spring force of flexible sheet 28-2 then reverses the paper 4. To this end, the length of the lower flexible sheet 28-2 is made 150 mm or more to reverse the paper 4 by the resiliency of the flexible sheet 28-2 irrespective of the unstable nature of the paper 4.

The sequence of reversal of the paper 4, which is discharged from the recording apparatus 1 by the discharge roller 9 and reversed and received by the media receiving unit, will now be described with reference to FIGS. 3A to D.

Figure 3A:
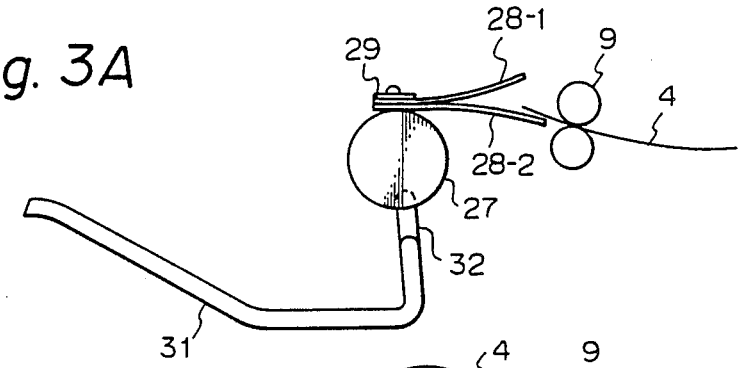
FIG. 3A, 3B, 3C and 3D are views for explaining the operation of the present invention.
Figure 3B:
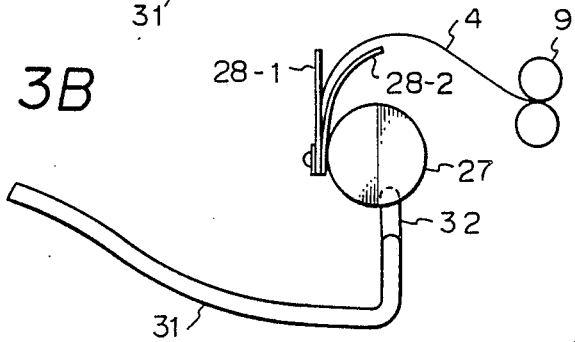

FIG. 3A shows a state wherein the leading edge of paper 4 has just been discharged from the discharge roller 9. The rotary drum 27 is in a standby (stop) state just before starting to rotate. This state is set by stopping the motor M according to a detection signal from a position sensor (not shown) which detects the position of the rotary drum 27. The flexible sheets 28-1 and 28-2 are arranged in such a manner that the paper 4 is easily introduced therebetween.

FIG. 3B shows a state in which the paper 4 has been inserted between the flexible sheets 28-1 and 28-2, and the rotary drum 27 has started to rotate.

The revolutional speed of the rotary drum 27 is about 0.8V, which is slower than the discharge speed $V_0$ of the paper 4 discharged from the discharge roller 9. Accordingly, as shown in FIG. 3B, the paper 4 is bent between the discharge roller 9 and the rotary drum 27. During this situation, the flexible sheet 28-2 is forced to bend convexly backward by the paper 4.

Figure 3C:
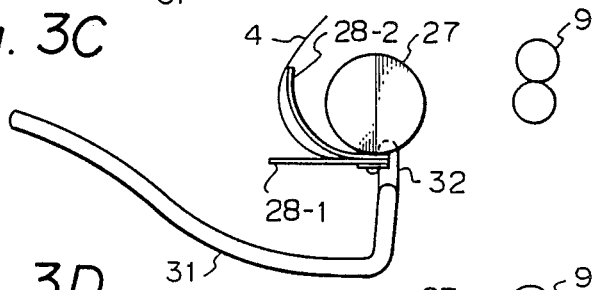
Figure 3D:
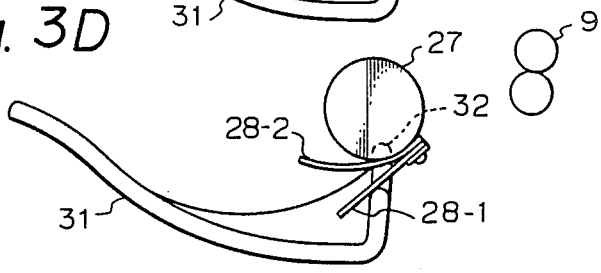

Then, as shown in FIG. 3C, the rear end of the paper 4 is flipped by the elastic restoring force of the flexible sheet 28-2 in accordance with the rotation of the drum 27. Then, the paper 4 is reversed as shown in FIG. 3D. The longer the length of flexible sheet 28-2, the better the reversal of the paper 4 caused by the resiliency of the flexible sheet 28-2, irrespective of the unstable nature of paper 4. The front end of the paper 4 then abuts against the stopper 32 and is released from the flexible sheets 28-1 and 28-2 and received in the stacker 31.

Figure 4:
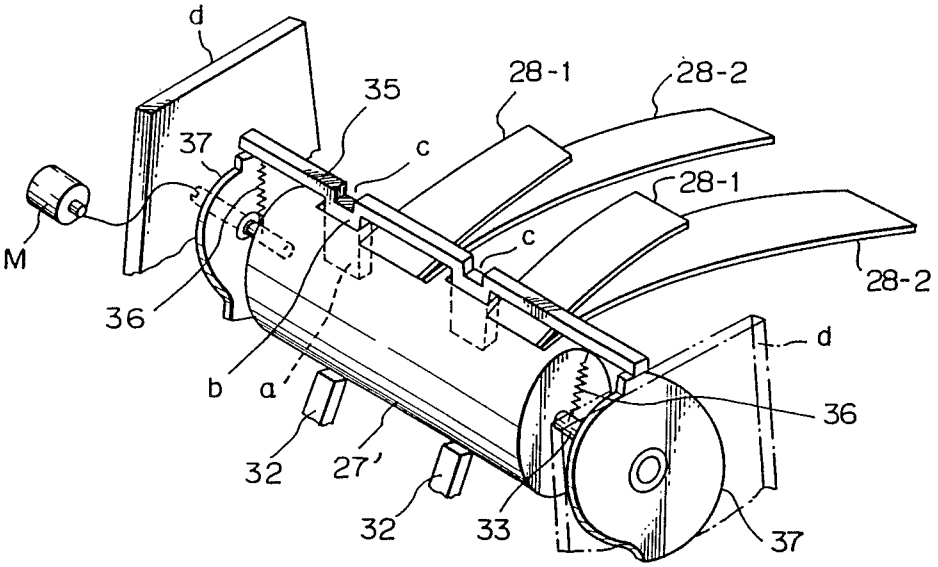
FIG. 4 is a view showing the constitution of the embodiment according to the present invention.

FIG. 4 is a perspective view showing another embodiment according to the present invention, in which a paper 4 fed between the flexible sheets 28-1 and 28-2 is securely held and completely reversed.

In FIG. 4, one end of the flexible sheets (films) 28-2 is fitted to a rotary drum 27'. A bar 35 is disposed in such a manner that the bar 35 can move radially relative to and in the vicinity of the periphery of rotary drum 27'. Projections a of the bar 35 engage with grooves b formed on the rotary drum 27'. Springs 36 are provided on both sides of the rotary drum 27' to press the bar 35 against the rotary drum 27'. The other flexible sheets 28-1 are fixed to an inner side of the bar 35 in such a manner that one end of the flexible sheets 28-1 is in contact with the flexible sheets 28-2. The flexible sheets 28-1 may be fixed to the rotary drum 27' instead of the bar 35.

Shafts 33 extending outwardly from both sides of the rotary drum 27' are rotatably supported by side plates d, and cams 37 are fixed to the side plates d. The cams 37 push the bar 35 upward when the flexible sheets 28-1 and 28-2 are located at upper positions to easily receive the paper 4 between the flexible sheets 28-1 and 28-2. According to the rotation of the rotary drum 27', the bar 35 is lowered due to the actions of cams 37 and securely holds the paper 4. When the rotary drum 27' rotates further, the paper 4 is reversed, and the bar 35 is pushed away from the drum 27' by the cam 37. The paper 4 is then released from the bar 35. Separation stoppers 32 are disposed to separate and release the paper 4 into a stacker 31 located below the rotary drum 27'. Recesses c are formed on the bar 35 to avoid interference of the bar 35 with the stoppers 32.

Figure 5:
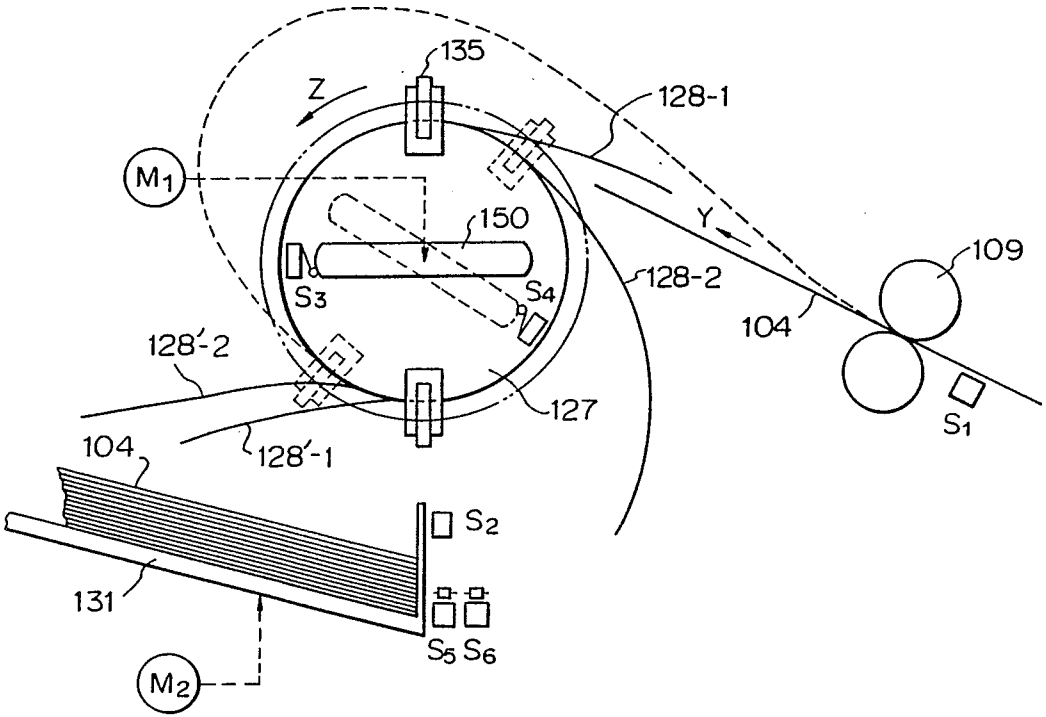
FIG. 5 is a side view showing an essential part of another embodiment according to the present invention.

FIG. 5 shows an arrangement of still another embodiment according to the present invention. Pairs of flexible sheets 128-1 and 128-2, and 128'-1 and 128'-2 are fixed at diametrically opposed positions on a rotary drum 127. The front ends of each pair of flexible sheets are aligned with each other, and a presser bar 135 corresponding to the bar 35 shown in FIG. 4 is provided at each of these front ends. A discharge roller 109 is arranged in a printer (not shown) to discharge a printed paper 104 in a direction indicated by an arrow Y. The rotary drum 127 is driven by a motor $M_1$ for rotation in a direction indicated by an arrow Z. A bar member 150 for detecting a rotational position of the rotary drum 127 is fixed to the rotary drum 127. As in the previous embodiment, the paper 104 is held between one of the pairs of flexible sheets, reversed, and then received in a stacker 131. The stacker 131 can be reciprocated along an axis of rotation (perpendicular to the plane of FIG. 5) of the rotary drum 127 by a motor $M_2$ for offset driving. Thus, the stacker 131 can be moved to sort the printed papers according to the document.

A photosensor $S_1$ for detecting papers is disposed adjacent to the discharge roller 109 of the printer, and a photosensor $S_2$ is used to detect whether or not the stacker 131 is full of paper. A microswitch $S_3$ for detecting a home position detects that one (in this case, 128-1 and 128-2) of the pairs of flexible sheets 128-1 and 128-2, and 128'-1 and 128'-2 of the rotary drum 127 has reached a position (indicated by a continuous line) at which it can for receive the paper 104; microswitch $S_4$ for detecting a standby position detects that one of the pairs of flexible sheets has reached a position (indicated by a dash line) which is thirty degrees before the home position; switch $S_5$ detects a normal position of the stacker 131; and a switch $S_6$ detects an offset position of the stacker 131.

The operation of the embodiment shown in FIG. 5 will now be described. The rotary drum 127 is in an optional position before it is energized. When the motor $M_1$ is driven, the drum 127 is rotated in a direction indicated by the arrow Z and stopped at the home position if the bar member 150 reaches the switch $S_3$. The stacker 131 is set to the normal position according to the drive of motor $M_2$. When the printed paper 104 is transported, the sensor $S_1$ detects a passage of the front end of the paper 104. After the detection of the front end of the paper 104, and after the elapse of time during which the front end of paper 104 reaches a chuck portion (a position where the presser bar 135 is located) of the flexible sheets in the home position, the motor $M_1$ starts to rotate. The timing of the drive of motor $M_1$ is calculated in advance according to a distance between the sensor $S_1$ and the chuck portion of flexible sheets and a discharge speed of a paper. On this occasion, the rotation speed of the drum 127 is set to be slower than the discharge speed of a paper 104 caused by the discharge roller 109.

If the paper 104 is long, the rotary drum 127 is rotated by 150° to reach the standby position indicated by a dash line before the sensor $S_1$ detects the rear end of the paper 104, and the sensor $S_4$ detects that the standby position is attained and stops the rotation of motor $M_1$. At this standby position, the rear end of paper 104 is continuously discharged from the discharge roller 109 while the front end of paper 104 is held and stopped. After the detection of the rear end of paper 104 by the sensor $S_1$ and after the elapse of time during which the rear end of the paper 104 travels from the sensor $S_1$ to the discharge roller 109, namely, when the paper 104 is released from the discharge roller 109, the motor $M_1$ is again driven to flip the rear end portion of the paper 104 by the resiliency of lower flexible sheet 128-2 while holding the front end of the paper 104 to reverse the paper 104. In this occasion, the motor $M_1$ is driven faster than a normal speed. The presser bar 135 is then released by the cam means described before, and the front end of the paper 104 abuts against stoppers in the same manner as in the previous embodiment and is separated from the flexible sheets 128-1 and 128-2 to drop in the stacker 131. The other pair of flexible sheets 128'-1 and 128'-2 then comes to the home position that is detected by the sensor $S_3$ to stop the rotation of motor $M_1$ until the next paper is discharged.

If the paper 104 is short, the sensor $S_1$ detects the rear end of paper 104 before the sensor $S_4$ detects that the drum 127 reaches the standby position. Namely, that before the drum 127 is rotated by 150°, the rear end of paper 104 is discharged from the discharge roller 109. In this case, similar to the previous case, the motor $M_1$ is rotated with an accelerated speed after the detection of the rear end of paper 104 by the sensor $S_1$ and after the elapse of time during which the rear end of paper 104 travels from the sensor $S_1$ to the discharge roller 109. In this case, however, the motor $M_1$ is not stopped at the standby position but continuously rotated until the other pair of flexible sheets comes to the home position.

When a stacker offset instruction is generated to sort printed papers for each document unit and pile them in the stacker 131, the stacker 131 is moved by the motor $M_2$. The sensors $S_5$ and $S_6$ detect a position of the stacker 131 to be moved and stop the motor $M_2$ at a predetermined position. This document collating operation will be described later. If the photosensor $S_2$ comprising a light emitting element and a photosensitive element detects that the stacker 131 is full of papers, a print termination signal is generated, and the printing operation and the reversing operation are stopped after the paper being discharged from the discharge roller 109 is reversed and received in the stacker 131.

Figure 6A:
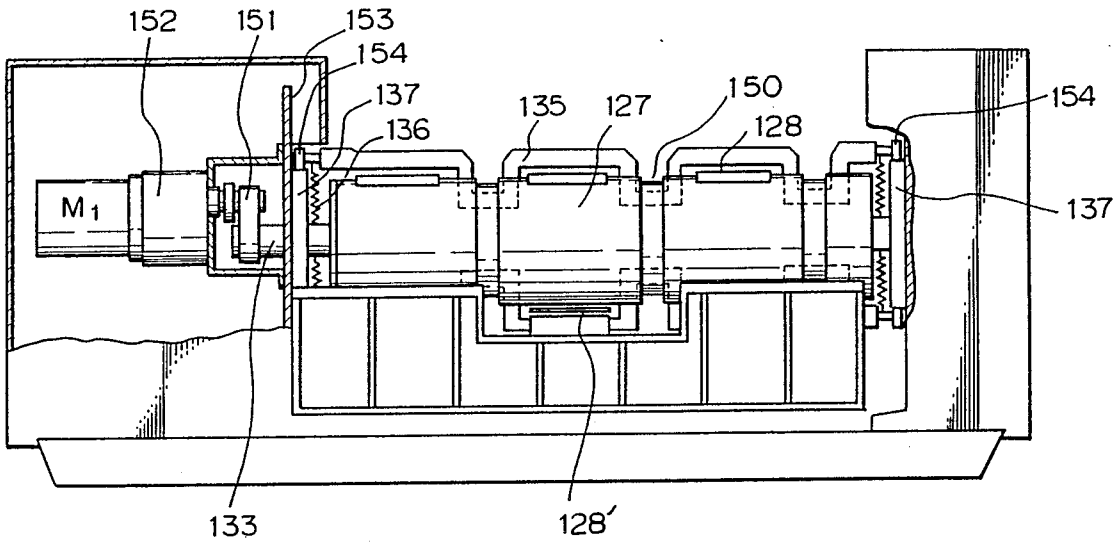
Figure 6B:
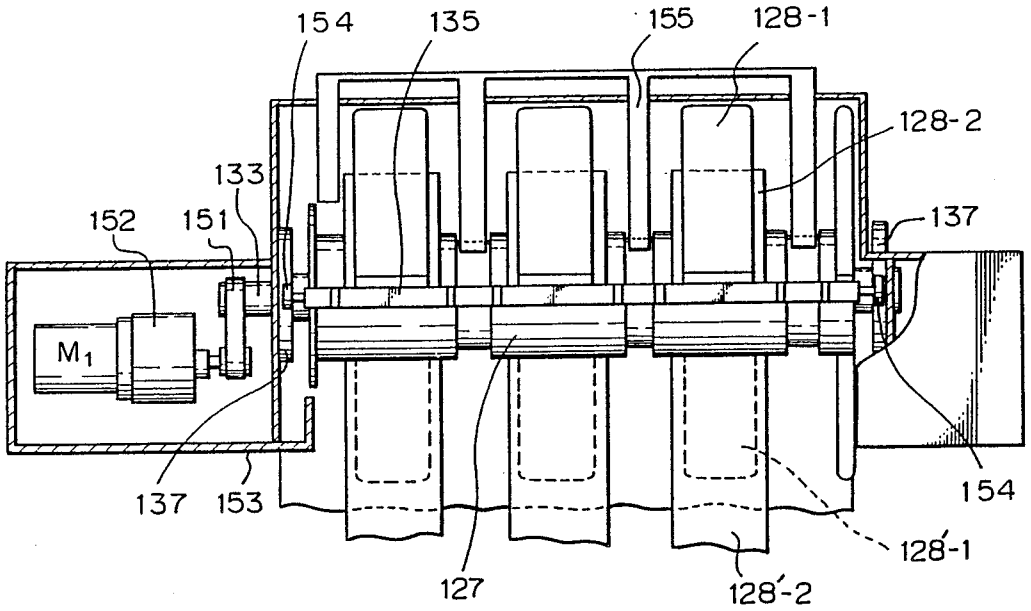
Figure 6C:
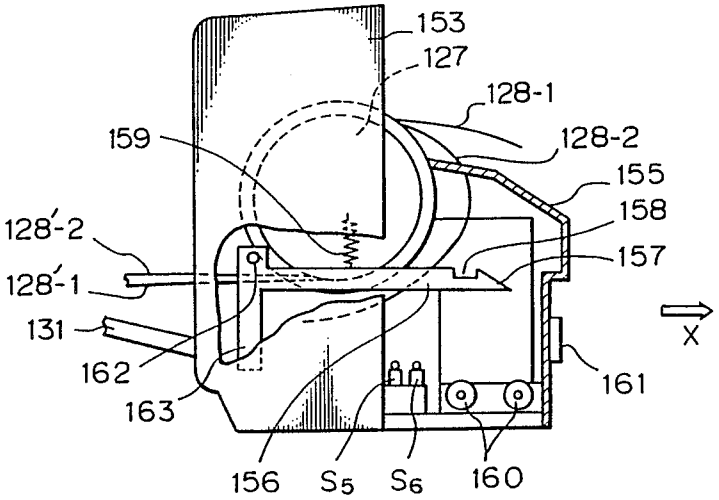

FIGS. 6AC are overall views of the reversing mechanism having the constitution mentioned above, in which FIG. 6A is a front view, FIG. 6B a plan view, and FIG. 6C a side view. Two pairs of flexible sheet pairs 128 and 128' are provided at each of three locations along the rotary drum 127. The sheet pairs 128 and 128' comprise upper short flexible sheets 128-1 and 128'-1 respectively, and lower long flexible sheets 128-2 and 128'-2 respectively. With respect to flexible sheet pairs 128 and 128', two presser bars 135 are oppositely provided on the periphery of and along the drum 127. Both ends of each presser bar 135 are pulled by springs 136 toward a shaft 133 of the drum 127, and the shaft 133 is supported by frames 153. Cams 137 similar to the cams shown in FIG. 4 are fixed to the frames 153, and cam followers 154 provided at ends of the presser bars 135 slide on the cams 137. The rotary drum 127 is driven by a motor $M_1$ which is connected to the shaft 133 through a reduction gear 152 and a belt 151. Annular grooves 150 are formed on the rotary drum 127 between the positions at which the flexible sheets are fitted. Separation stoppers (not shown) similar to those shown in the previous embodiment are disposed in the annular grooves.

The shapes of the flexible sheets in the home position are shown in FIG. 6C. As shown in the figure, the lower long flexible sheet 128-2 is bent along the rotary drum 127 and does not project outward, so that a space for arranging the flexible sheets does not need to be increased even if the length of each flexible sheet is elongated. The numeral 155 represents a paper guide frame. The side frame 153 has a bent lever 156 which is provided to a shaft 162 to attach the reversing mechanism to a printer. The lever 156 is pulled upward by a spring 159 and keeps a horizontal position due to a stopper (not shown). A tapered face 157 is formed at the front end of the bent lever 156, and a recess 158 is formed on a back side of the tapered face 157. Rollers 160 slide on a guide rail (not shown) of the printer. A connector 161 is provided under the paper guide frame 155. The connector 161 is for connecting power lines, signal lines, etc., of the reversing mechanism with the printer. The media receiving unit including such a reversing mechanism is constructed solidly as a single unit and fitted to the printer. To attach the media receiving unit to the printer, the media receiving unit is engaged in a direction indicated by an arrow X shown in FIG. 6C with the printer. At this moment, the rollers 160 slide on the guide rail (not shown) of the printer, and the tapered face 157 of the bent lever 156 abuts against a pin (not shown) fixed to the printer. The bent lever 156 is then pushed downward by the pin, and the pin enters the recess 158 to be locked therein. In order to release the lock, an end 163 of the lever 156 is pulled to lower the recess 158. The connector 161 is aligned with a connector (not shown) of the printer in advance so that they may be coupled together according to the above attaching process.

Figure 7:
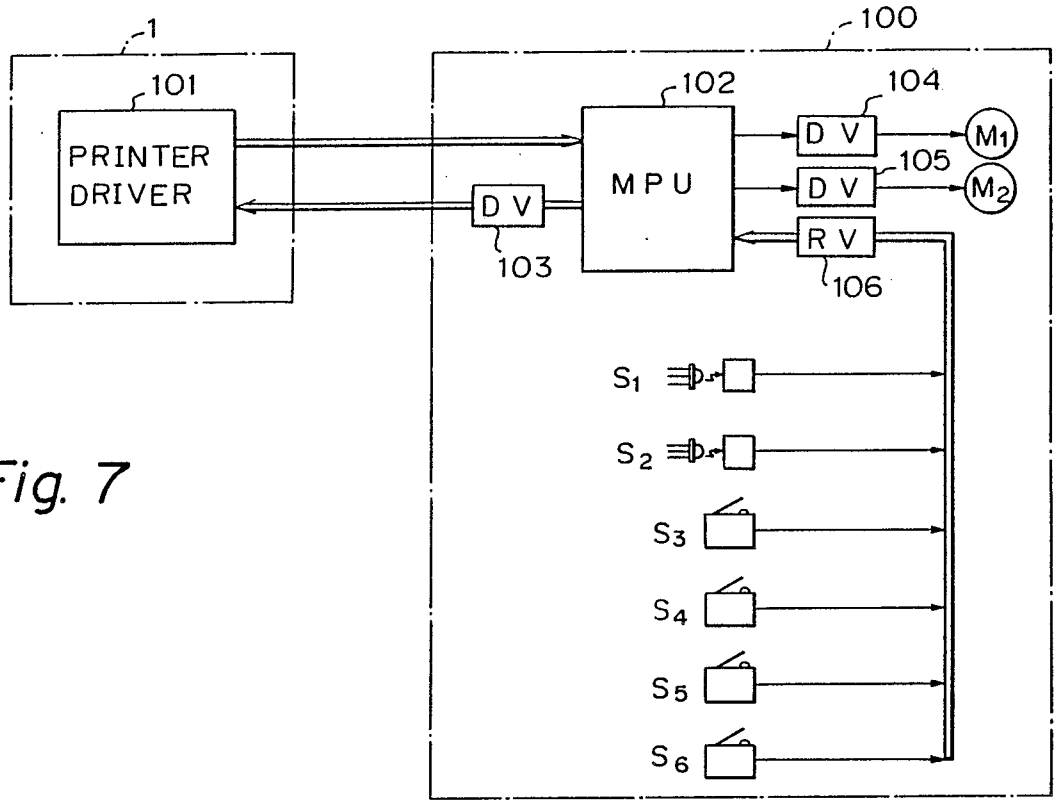
FIG. 7 is a block diagram showing the embodiment shown in FIGS. 6A–C.

FIG. 7 shows a circuit diagram for controlling the reversing operation mentioned above. The numeral 1 represents the printer, and 100 the reversing mechanism. A circuit 101 for controlling the operation of printer 1 is connected with a microprocessor unit (MPU) 102 for controlling the reversing operation. The numerals 103, 104, and 105 represent driving circuits, and 106 a receiver circuit. The MPU 102 incorporates RAMs, ROMs, I/0 ports, timers, etc., and controls the operation of the motors $M_1$ and $M_2$ according to printing signals and signals from the sensors $S_1$ to $S_6$ to reverse the printed papers and control the movement of a stacker.

Figure 8:
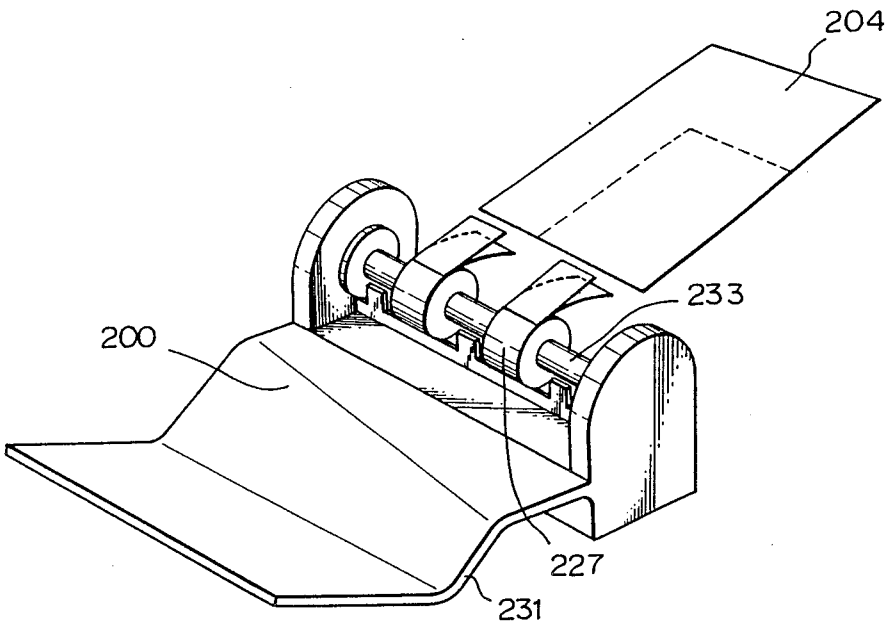
FIG. 8 is a perspective view showing still another embodiment according to the present invention.

FIG. 8 is a perspective view showing still another embodiment according to the present invention. In this embodiment, the stacker 231 has a modified shape. A projection 200 is formed on the stacker 231 and is located in such a manner that it will be positioned within a front half of a paper 204 which is reversed and received in the stacker 231. Due to the projection 200, a rear end of the paper 204, particularly when the paper 204 is long, will not be folded toward a front end thereof after the paper 204 is reversed. The paper 204 is flipped backward by an inertial force of the reversing action and dropped along a slanted surface on a back side of the projection 200 so that the reversing and receiving operations of the paper 204 will be securely carried out. If an edge of the paper 204 is aligned with a reference edge, which will be one side edge (a right side edge in the embodiment shown in FIG. 8) of a discharge port of a printer, the projection 200 may be formed in a ridge like shape which does not run in parallel with a rotation shaft 233 of a rotary drum 227 for reversing a paper. This shape of the projection 200 realizes a correct reversing operation with respect to particularly a large size paper.

Figure 9:
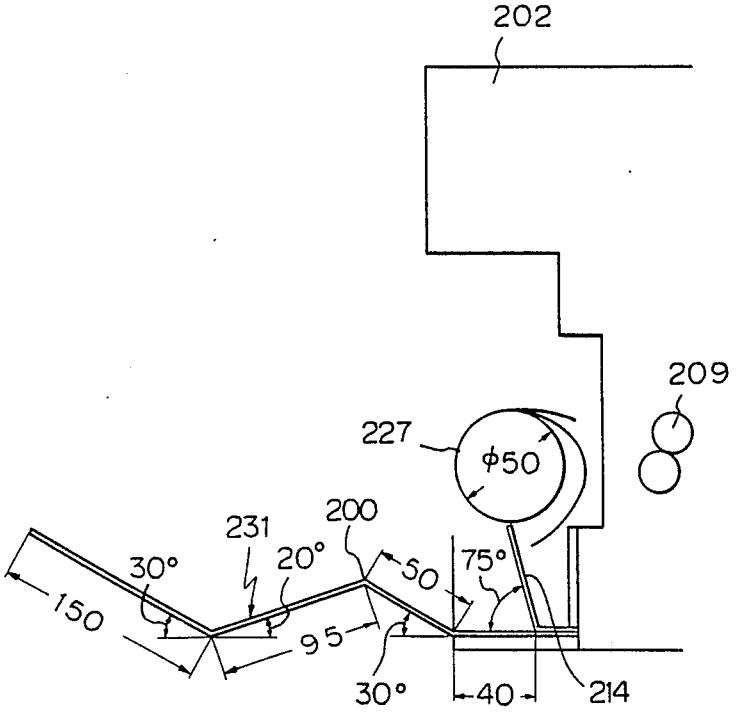
FIG. 9 is a view showing dimensions of the embodiment shown in FIG. 8.

If the size of a paper is "B4", the dimensions of stacker shown in FIG. 9 are suitable. In FIG. 9, the numeral 214 represents a separation stopper, 202 a printer, and 209 a discharge roller. Dimensions in the figure are in millimeters.

Figure 10:
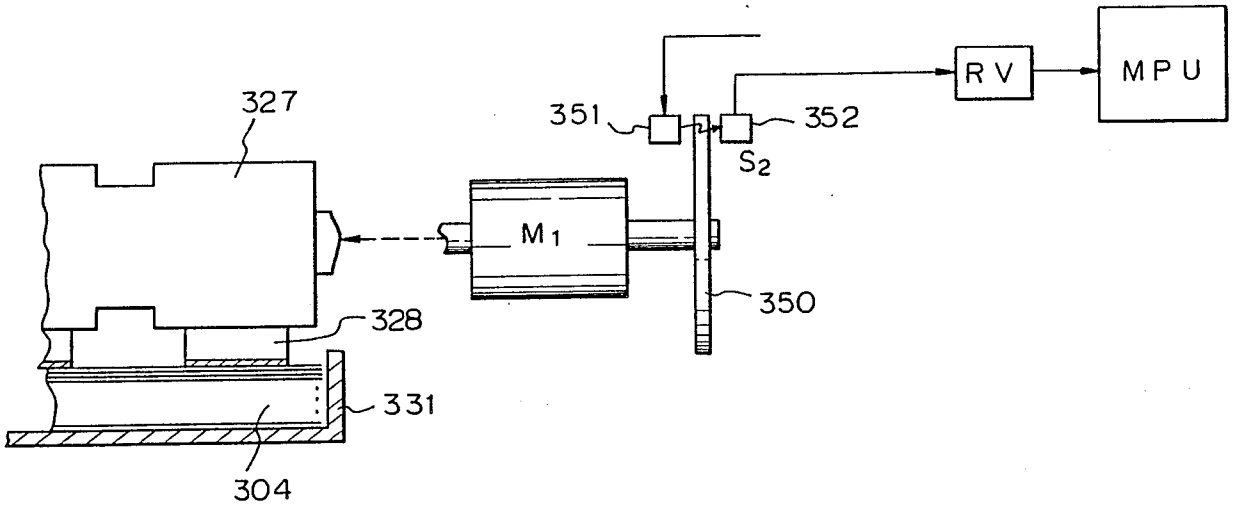
FIG. 10 is a view showing the constitution of still another embodiment according to the present invention.

FIG. 10 is a view showing another constitution of a stacker-full detection sensor in the media receiving unit according to the present invention. A motor $M_1$ for driving a rotary drum 327 is provided with an encoder 350 for controlling the operation of a motor Ml. The encoder 350 has a plurality of through holes (not shown) arranged circumferentially at a given radius, and a photosensor $S_2$ comprising a light emitting element 351 and a photosensitive element 352 is disposed corresponding to the positions of the through holes. Since the flexible sheets 328 provided on the rotary drum 327 slide on the top of the paper 304 stacked in a stacker 331, resistance to the rotation the drum 327 will be increased to decrease the rotating speed thereof if the amount of paper is increased to raise the overall height of the papers. As a result, the rotating speed of the encoder 350 is decreased to decrease the number of through holes (the number of pulses) counted by the sensor $S_2$ for a predetermined period of time. If the counted number is zero, this signifies that the unit is in a jammed state.

Figure 11:
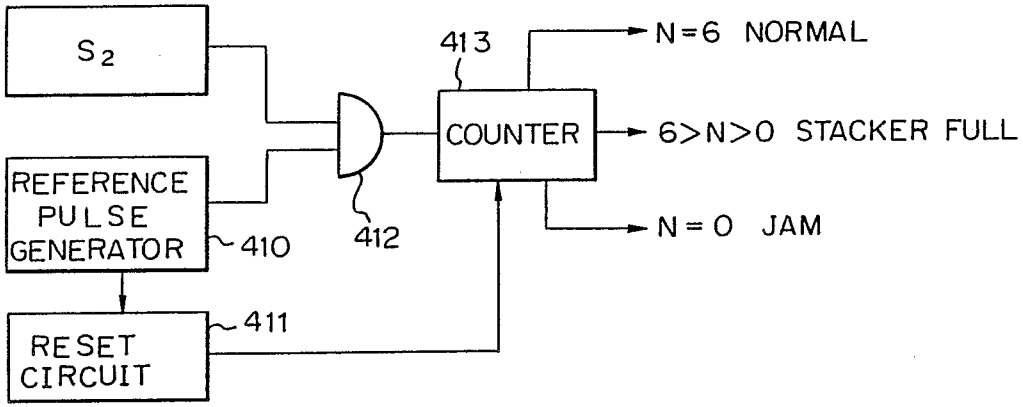
FIG. 11 is a circuit diagram showing the embodiment shown in FIG. 10.
Figures 12A, 12B, 12C, 12D, 12E, 12F, 12G, 12H, 12I, 12J:
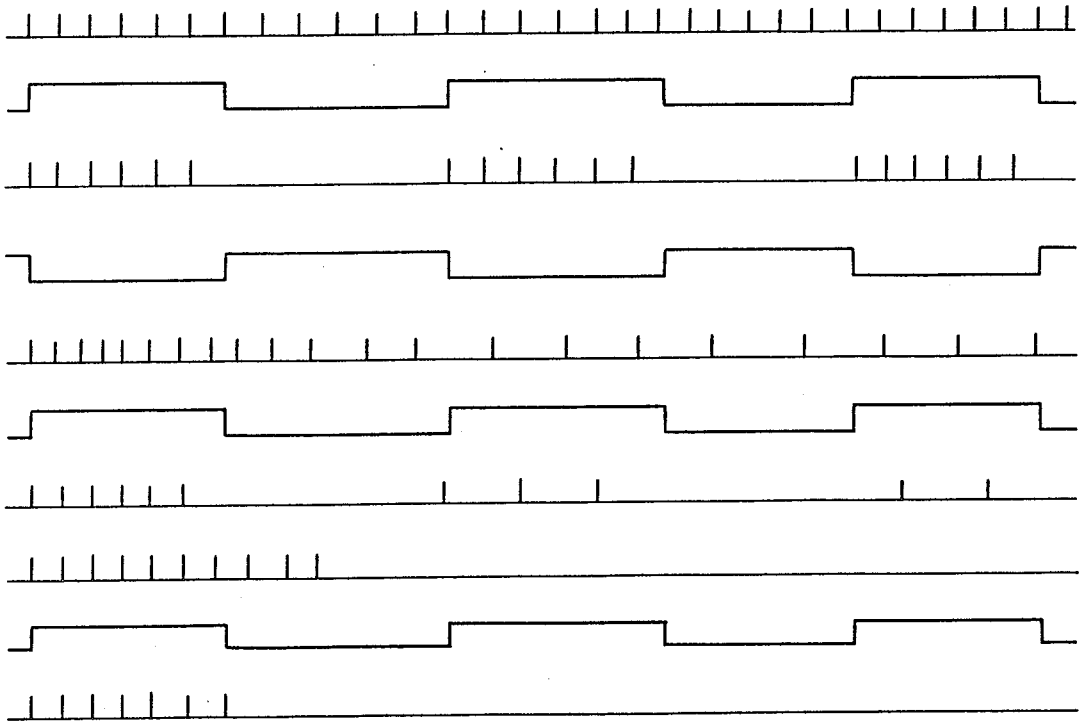
FIG. 12 is a view for explaining the operation of the circuit shown in FIG. 11.

FIG. 11 shows a detection circuit of the embodiment shown in FIG. 10. FIG. 12 is a time chart showing a normal rotation state, a stack full state, and a jammed state in the circuit shown in FIG. 11. The sensor $S_2$ and a reference pulse generating circuit 410 are connected to a counter 413 via an AND circuit 412. A reset circuit 411 is also connected to the counter 413. The marks (a), (e), and (h) shown in FIG. 12 represent pulse detection signals generated by the encoder and the sensor $S_2$. The signal (a) indicates the normal rotation state, (e) the stack full state, and (h) the jammed state. The marks (b), (f), and (i) represent reference pulses, and the marks (c), (g), (j) represent the counter outputs corresponding to the above three states respectively. In this example, the counter output (c) of count number N=6 indicates the normal rotation. In the output (g), the count number N decreases gradually, and in the counter output (j), the count number is N=0 due to jamming. The mark (d) represents reset pulses which are inverted signals of the reference pulses.

Figure 13:
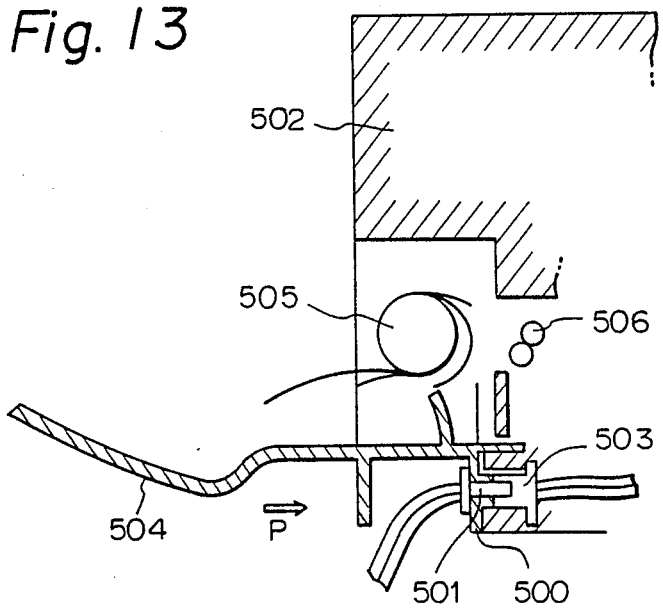
FIG. 13 is a view showing the constitution of still another embodiment according to the present invention.

FIG. 13 shows an engaging state of connectors where the media receiving unit according to the present invention is unitized in one body and attached to a printer. A connector 501 is fixed to a frame 500 of the media receiving unit. The media receiving unit is fitted to a printer 502 in a direction indicated by an arrow P, and, at the same time, the connector 501 is coupled with a connector 503 provided on the printer 502. The numeral 504 represents a stacker, 505 a rotary drum, and 506 a discharge roller.

Figure 14:
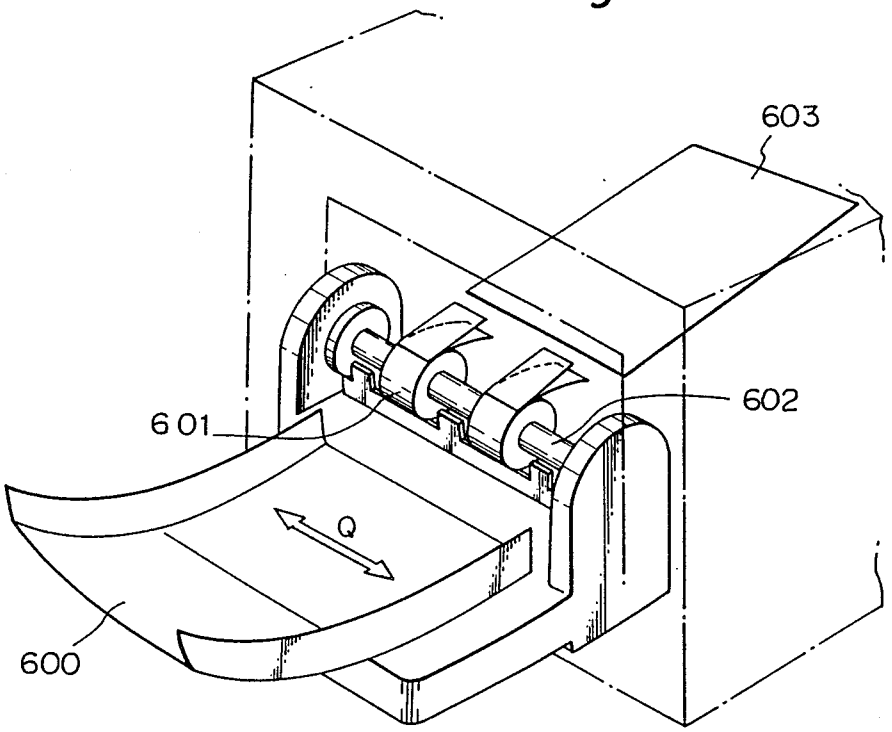
FIG. 14 is a perspective view showing still another embodiment according to the present invention.

FIG. 14 shows still another embodiment according to the present invention. In this embodiment, printed papers are sorted for every document and accumulated in a tray (stacker). As shown in FIG. 14, a tray 600 is movable in directions indicated by an arrow Q in parallel with a rotation shaft 602 of a rotary drum 601 so that printed papers 603 to be discharged will be piled up in the tray 600 at predetermined positions.

Figure 15:
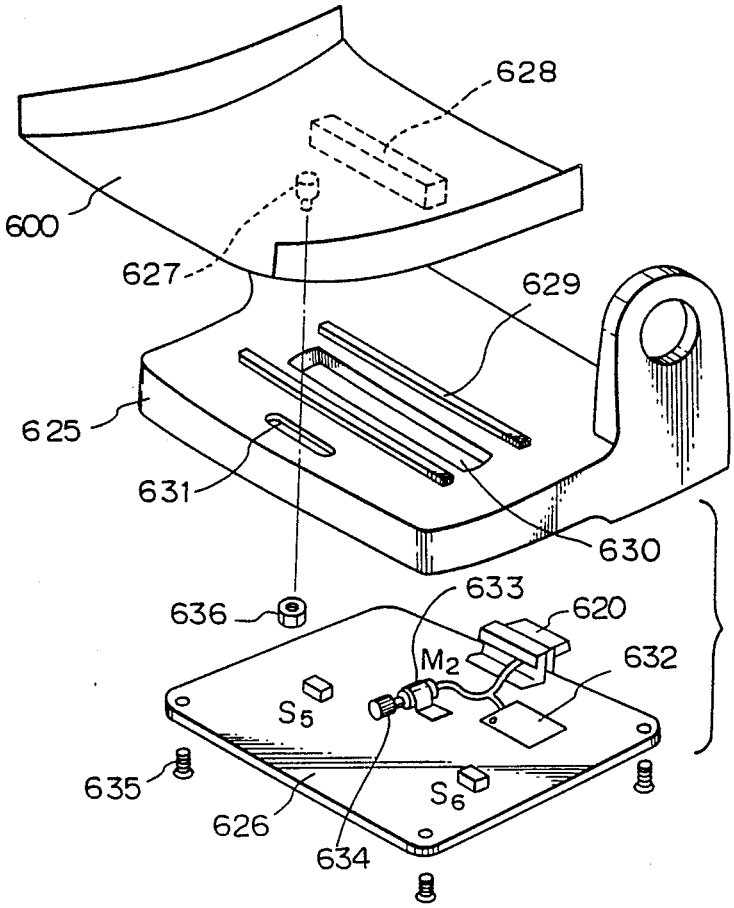
FIG. 15 is an exploded perspective view showing the embodiment shown in FIG. 14.

FIG. 15 shows the constitution of a tray moving mechanism. Under the tray 600 of the reversing mechanism, a support base 625 and a back plate 626 are assembled in one body, and a guide pin 627 and a rack 628 are provided on the back side of tray 600. If the tray 600 is made of resin, the guide pin 627 and the rack 628 may be formed integrally therewith. On the support base 625, a rail 629 for sliding the tray 600 and holes 630 and 631 for horizontal positioning are provided. A gap between the width of rack 628 and the width of hole 630 is 0.2 to 0.5 mm. The back plate 626 is attached to the reverse side of support base 625, and a connector 620 fitted to the back plate 626 engages with a connector on the printer side. The connector 620 is connected to a control circuit 632, which cause a motor $M_2$ 633 to rotate to move the tray 600 by the engagement between a pinion 634 and the rack 628. The numerals 635 and 636 represent fitting screws.

Figure 16A:
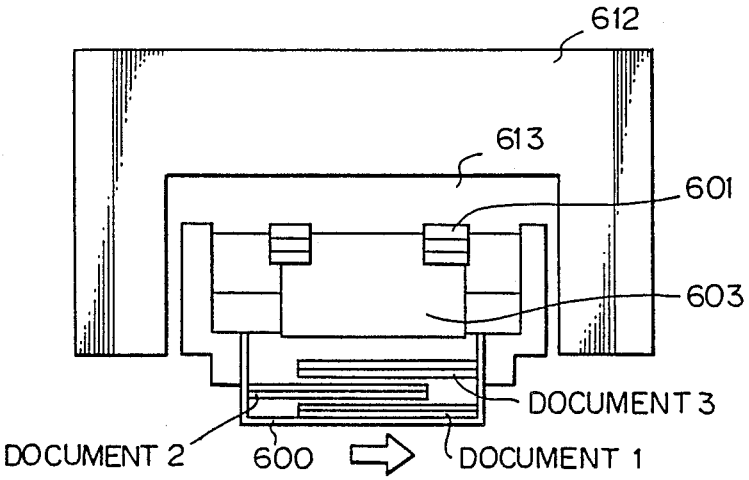
FIG. 16A and 16B are views for explaining the operation of the embodiment shown in FIG. 14.
Figure 16B:
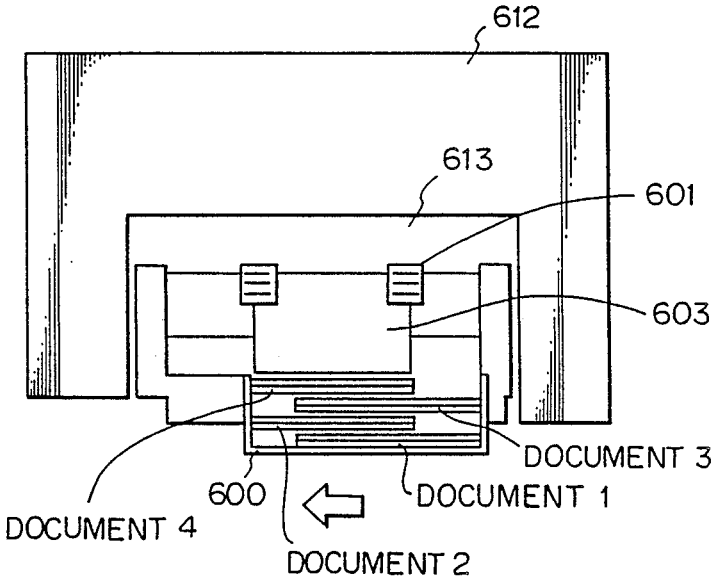

FIGS. 16A and B describe the reciprocating movement of tray 600. In the figures, a paper 603 discharged from a discharge port 613 of a recording apparatus 612 is reversed by a rotary drum 601 of the reversing mechanism, and is piled up in the tray 600. Whenever a document is changed, the motor 633 is driven according to a signal from the apparatus 612 to move the tray 600 so that the papers will be sorted for each document and piled up in the tray 600. The movement of tray 600 is detected by limit switches $S_5$ and $S_6$ similar to the sensors $S_5$ and $S_6$ described in the embodiment shown in FIG. 5.

Figure 17:
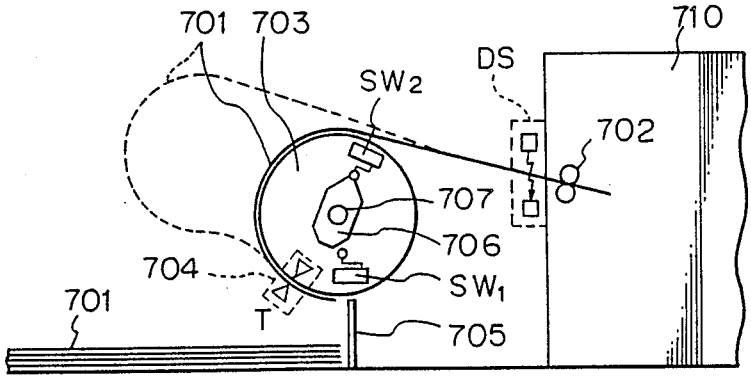
FIG. 17 is a view showing the constitution of still another embodiment according to the present invention.

FIG. 17 shows still another embodiment according to the present invention. As shown in FIG. 17, a media receiving mechanism of the embodiment comprises a photosensor DS for detecting a medium 701 discharged from a discharge roller 702 of a printer 710; a cam 706 fitted to a rotation shaft 707 of a drum 703; and a pair of cam switches SW1 and SW2 which are turned ON and OFF by the cam 706. A standby position T is set in front of (i.e., in the figure, on the left side of) a stopper 705 for separating discharged papers. At the position T, the modes of operation of the drum 703 and chuck 704 are decided after a front end of the medium 701 reaches a point just before the stopper 705.

If the medium 701 is not detected by the photosensor DS when the front end of medium 701 is just before the stopper 705, namely, if the medium 701 has been completely discharged, the drum 703 continues to rotate irrespective of the standby position T, and the chuck 704 releases the medium 701. On the other hand, if the medium 701 is detected by the photosensor DS, namely, if the medium 701 is not yet completely discharged, the drum 703 is stopped temporarily at the standby position T, and the chuck 704 continues to hold the medium 701 until the medium 701 is completely discharged.

In the latter case, the front end of medium 701 is kept at the point just before the stopper 705 until the rear end of medium 701 is discharged, and once the discharge is completed, the front end of medium 701 is released so that a misreversal can not occur.

Figure 18:
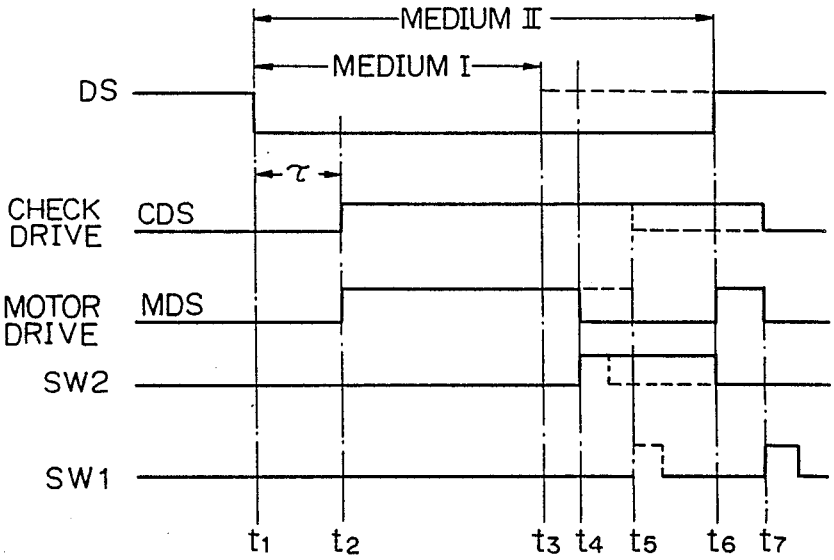
FIG. 18 is a time chart showing the embodiment shown in FIG. 17.
Figure 19:
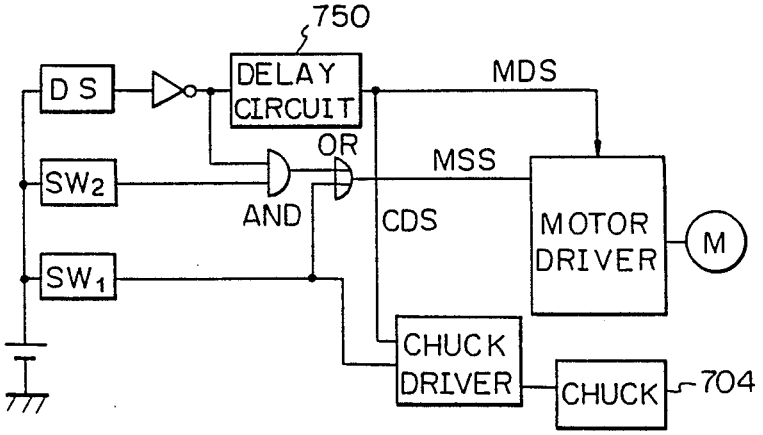
FIG. 19 is a circuit diagram showing the embodiment shown in FIG. 17.

The operation of the above embodiment will be described with reference to FIG. 18 which is an operation timing chart, and FIG. 19 which shows an example of a circuit of the embodiment. Marks used in the following description correspond to the marks shown in FIGS. 17 to 19.

(1) The photosensor DS detects a passage of the front end of medium 701 at the time $t_1$. At the timing $t_2$ after the elapse of time t after the time $t_1$, a delay circuit 750 outputs a chuck driving signal CDS and a motor driving signal MDS. According to the signals, the medium 701 is held, and the drum 703 starts to rotate.

(2) In the case of a short medium I, the light shielded by the medium I is released at the timing $t_3$ to cause the output of photosensor DS to become 0 (low). Under these conditions, even if the drum 703 is rotated to close the cam switch SW2, the rotation of motor M is not stopped but continued up to the timing $t_5$ when the cam switch SWI is closed.

(3) In the case of a long medium II, the inverted output of sensor DS is 1 (high) because the light is shielded by the medium II when the output of the cam switch SW2 becomes 1 (high) at the timing $t_4$. As a result, a motor stopping signal MSS is output through an AND gate and OR gate to temporarily stop the motor.

(4) Under these conditions, only the medium 701 is advanced. When the sensor DS detects a passage of the rear end of the medium 701 at the timing $t_6$, the motor stopping signal MSS becomes 0 (low) to restart the motor M. The motor M is rotated up to the timing $t_7$ when the switch SWI is turned ON. At the timing $t_7$, the chuck 704 is released simultaneously to complete the reversing operation of the medium 701.

We claim:

1. A media receiving unit comprising:

a media reception means for receiving sequentially one upon another a plurality of sheet media which are discharged from discharge means of a media processing apparatus at a discharge speed $V_o$, said media reception means comprising a mechanism for reversing the media and an electrical driving means for driving the media reversing mechanism;

a means for detachably mounting the media reception means to the media processing apparatus; and a connector for making electrical power and signal connections between the media receiving unit reversing mechanism driving means and the media processing apparatus when mounted thereon, wherein a direction of connection of said connector is the same direction as a mounting direction of said means for detachably mounting the media reception means to the media processing apparatus.

2. A media receiving unit according to claim 1, wherein said media reversing mechanism further comprises:

a media receiving member movable laterally on a path perpendicular to the movement of the media to change the position of the media received therein according to the sorting thereof, and means for laterally moving the media receiving member, and wherein said media processing apparatus is further provided with signal lines connected thereto to receive commands through the connector for changing the position of the receiving member with respect to the received media.

3. A media receiving unit according to claim 1, wherein said means for detachably mounting the media reception means to the media processing apparatus comprises:

a first connector fixed to a frame of the media receiving unit, a second connector provided on the media processing apparatus for coupling with said first connector, and a spring biased locking lever fixed to the receiving unit for locking to the processing apparatus when the first and second connectors are coupled.

4. A media receiving unit comprising:

a media reception means for receiving sequentially one upon another a plurality of sheet media which are discharged from discharge means of a media processing apparatus at a discharge speed $V_o$, said media reception means comprising a mechanism for reversing the media and an electrical driving means for driving the media reversing mechanism;

a means for detachably mounting the media reception means to the media processing apparatus; and a connector for making electrical power and signal connections between the media receiving unit reversing mechanism driving means and the media processing apparatus when mounted thereon, wherein a direction of connection of said connector is the same direction as a mounting direction of said means for detachably mounting the media reception means to the media processing apparatus, such that connection of said electrical connector is established by mounting the media reception means to the media processing apparatus, and connection of said electrical connector is broken by dismounting the media reception means from the media processing apparatus.

5. A media receiving unit comprising:

a media reception means for receiving sequentially one upon another a plurality of sheet media which are discharged from discharge means of a media processing apparatus at a discharge speed $V_o$, said media reception means comprising a mechanism for reversing the media and an electrical driving means for driving the media reversing mechanism;

a means for detachably mounting the media reception means to the media processing apparatus;

a connector for making electrical power and signal connections between the media receiving unit reversing mechanism driving means and the media processing apparatus when mounted thereon, wherein a direction of connection of said connector is the same direction as a mounting direction of said means for detachably mounting the media reception means to the media processing apparatus; and wherein said mechanism for reversing the media comprises a rotary member having an axis of rotation which extends perpendicular to a discharging direction of media from said media processing apparatus, said rotary member being rotated at a peripheral speed slower than $V_o$ and having at its periphery at least one pair of flexible sheets for receiving and holding discharged media therebetween and for releasing said media in a reversed position.

6. A media receiving unit including a media reception means for receiving sequentially one upon another a plurality of sheet media which are discharged from discharge means of a media processing apparatus, wherein said media reception means comprises:

a media receiving member for receiving sheet media one upon another, said member having a support base and a tray movable laterally thereon on a path perpendicular to a path of movement of the media to change the position of the media received in said tray to sort said media into laterally displaced stacks;

means for laterally moving the tray comprising a rack fixed to said tray and extending through a hole formed in said support base, and a pinion engaged with said rack and driven by a motor fixed to said support base; and control means for controlling said motor to move the tray according to control signals provided thereto.

7. A media receiving unit according to claim 6, further comprising a means for detachably mounting the media reception means to the media processing apparatus; and a connector for making electrical power and signal connections between the media receiving unit and the media processing apparatus when mounted thereon, wherein a direction of connection of said connector is the same direction as a mounting direction of said means for detachably mounting the media reception means to the media processing apparatus.

8. A media receiving unit according to claim 7, wherein said media processing apparatus and said media reception means are further provided with signal lines connected thereto to transmit control signals through the connector for changing the position of the receiving member with respect to the received media.

9. A media receiving unit according to claim 7, wherein said means for detachably mounting the media reception means to the media processing apparatus comprises:

a first connector fixed to a frame of the media receiving unit;

a second connector provided on the media processing apparatus for coupling with said first connector; and a spring biased locking lever fixed to the receiving unit for locking to the processing apparatus when the first and second connectors are coupled.

10. A media receiving unit as recited in claim 6 wherein said mechanism for reversing the media comprises a rotary member having an axis of rotation which extends perpendicular to a discharge direction of said media, said rotary member having at its periphery a pair of flexible sheets for receiving and holding said media therebetween and being rotatable at a peripheral speed lower than $V_o$.

* * * * *